United States Patent [19]

Feather et al.

[11] Patent Number: 4,859,978

[45] Date of Patent: Aug. 22, 1989

[54] HIGH-VOLTAGE WINDINGS FOR SHELL-FORM POWER TRANSFORMERS

[75] Inventors: Landis E. Feather, Hermitage; Ramsis S. Girgis, Mars; Leach S. McCormick; Andreas M. Sletten, both of Pittsburgh, all of Pa.

[73] Assignee: Electric Power Research Institute, Inc., Palo Alto, Calif.

[21] Appl. No.: 188,239

[22] Filed: Apr. 29, 1988

[51] Int. Cl.[4] ..... H01F 27/28

[52] U.S. Cl. ..... 336/186; 174/114 R; 174/119 R; 336/187; 336/205; 336/223

[58] Field of Search ..... 336/69, 70, 223, 186, 336/187, 223, 205, 206, 183; 174/114 R, 114 S, 119 R

[56] References Cited

U.S. PATENT DOCUMENTS

| | | | |
|---|---|---|---|
| 2,978,530 | 4/1961 | Braeckman | 174/119 R |
| 3,237,136 | 2/1966 | Ford | 336/206 X |
| 3,312,775 | 4/1967 | Lambert | 174/120 |
| 3,466,584 | 9/1969 | Kashima | 336/70 |
| 3,467,931 | 9/1969 | Dutton | 336/180 |
| 3,579,084 | 5/1971 | Moyer | 336/69 |
| 3,647,932 | 3/1972 | Heller et al. | 336/187 |
| 3,688,233 | 8/1972 | Moore et al. | 336/187 X |
| 3,925,743 | 12/1975 | Van Nice | 336/70 |
| 4,013,987 | 3/1977 | Foster | 336/206 |
| 4,239,077 | 12/1980 | Dixon et al. | 156/272 |
| 4,431,860 | 2/1984 | Perco et al. | 174/34 |
| 4,439,256 | 5/1984 | Meserve | 156/50 |
| 4,473,716 | 9/1984 | Jesseman | 174/117 |
| 4,489,298 | 12/1984 | Hall | 336/223 X |
| 4,546,210 | 10/1985 | Akiba et al. | 174/114 R |
| 4,549,042 | 10/1985 | Akiba et al. | 336/223 |
| 4,554,523 | 11/1985 | Miki et al. | 336/70 |
| 4,554,730 | 11/1985 | Westervelt et al. | 29/605 |

FOREIGN PATENT DOCUMENTS 580524 8/1958 Italy .

*Primary Examiner*—Thomas J. Kozma

*Attorney, Agent, or Firm*—Flehr, Hohbach, Test, Albritton & Herbert

[57] ABSTRACT

A high voltage electrical winding for shell form transformers is disclosed that reduces eddy current and circulating current losses within the winding. The winding is fabricated from an elongated conductor bundle that is spirally wound into a plurality of turns. The conductor bundle is formed from a multiplicity of enamel coated elongated conductor strands arranged in side by side relation. Each of the conductor strands has a rectangular cross section with a thickness of less than approximately 40 mils between contacting surfaces. The strand's cross sectional height is preferably less than 120 mils. The conductor strands are mounted side by side such that their respective contact surfaces abut. The conductor bundle is preferably wrapped in an adhesive tape to give the bundle some structural support and to provide insulation between winding turns. The disclosed winding also has very good mechanical strength and impulse distribution.

11 Claims, 3 Drawing Sheets

HIGH-VOLTAGE WINDINGS FOR SHELL-FORM POWER TRANSFORMERS

The present invention relates generally to an improved construction and winding method for a shell-form power transformer. More particularly, the invention provides a transformer winding formed of conductor bundles each having a number of extremely thin rectangular strands.

Modern transformer windings are fabricated using a wide variety of methods. In high power applications, a substantially rectangular shaped conductor strip is generally spirally wound about a core to form a coil. Often, the conductive strip itself is composed of a plurality of strands arranged side by side in a row. The strands themselves may be rectangular to both increase strength and provide a more compact transformer. A representative conductor construction is disclosed in U.S. Pat. No. 4,489,298.

There are several factors that influence transformer efficiency. Two of the most notable losses are caused by eddy current and circulating current within the windings. It has been realized that eddy current are dependant to a large extent on the dimensions of the conductors. Specifically, eddy current losses may be significantly reduced by reducing the dimensions of the conducting strands. Experiments have shown that conductor bundles comprised of a large number of finely stranded conductors have several advantages over prior conductor constructions.

Therefore, it is a primary objective of the present invention to provide a low loss high voltage power transformer.

A more specific objective of the present invention is to provide an improved high voltage winding that reduces eddy current and circulating current losses within the winding.

Another objective of the present invention is to provide a compact transformer construction that reduces the required transformer size.

To achieve the foregoing and other objects and in accordance with the purpose of the present invention a winding for an electrical induction device is disclosed that is designed to reduce eddy current losses. Thew inding is formed from an elongated conductor bundle that is spirally wound into a coil. The conductor bundle is formed from a multiplicity of enamel coated elongated conductor strands arranged in side by side relation. Each conductor strand has a substantially rectangular cross section with a pair of substantially parallel contact surfaces and a minor axis. The minor axis joins said contact surfaces. Each conductor strand is less than approximately (30) mils thick along its minor axis. The conductor strands are mounted side by side such that their respective contact surfaces abut.

In a preferred embodiment, the conductor bundles are wrapped with an adhesive tape to help hold the conductor strands together and to provide insulation between winding turns.

The features of the present invention that are believed to be novel are set forth with particularity in the appended claims. The invention, together with further objects and advantages thereof, may best be understood by reference to the following description taken in conjunction with the accompanying drawings in which:

Figure 1:
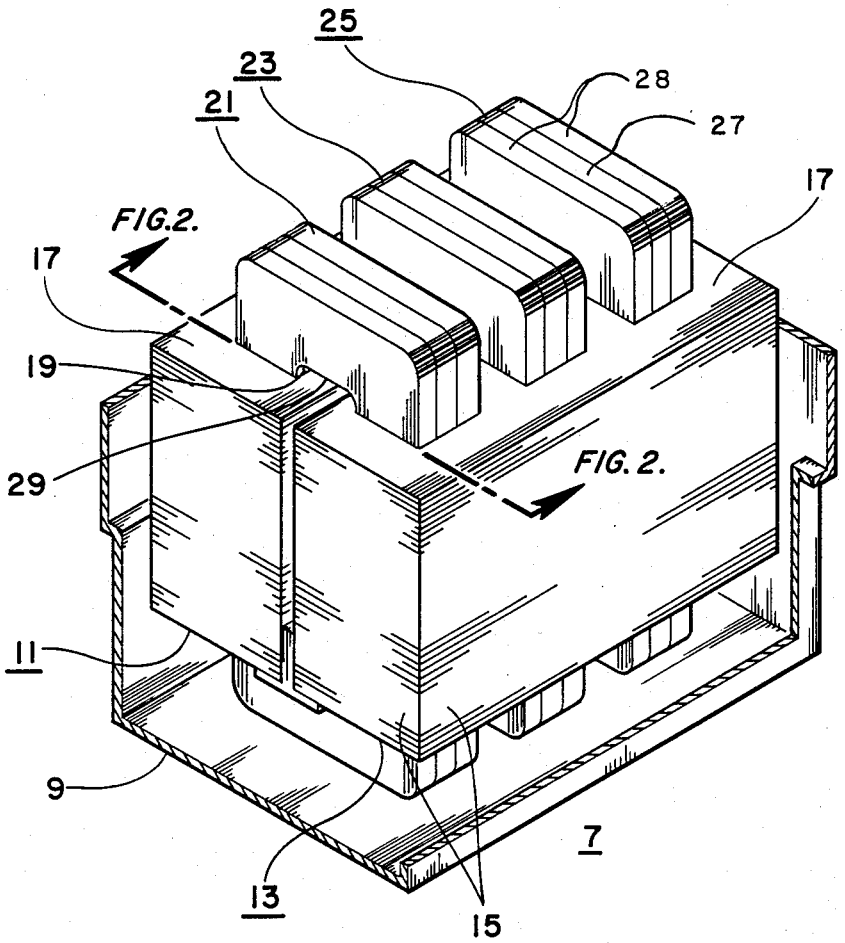
FIG. 1 is a perspective view with portions broken away of a transformer magnetic core-coil assembly.

As illustrated in the drawings, the present invention comprises a high voltage shell-form transformer having windings formed of ribbon cables consisting of a large numer of small rectangular strands. As seen in FIG. 1, a typical three phase shell-form transformer 7 is shown for illustrative purposes. It will be appreciated that any other form of transformer, such as single phase transformers would be equally operative for the purpose of this disclosure. The transformer 7 includes first and second magnetic core sectons 11,13 disposed in side by side relation. Each magnetic core section 11,13 has three winding openings such as opening 19. The transformer includes three electrical winding phases 21,23,25 each of which include a high voltage winding 27 sandwiched by a pair of low voltage windings 28. The windings 27,28 are stacked in side by side relation with the openings in the coils in alignment, forming openings 29 for receiving the magnetic core sections 11,13. It will be appreciated that multiple high voltage windings 27 could be used within each phase.

Figure 2:
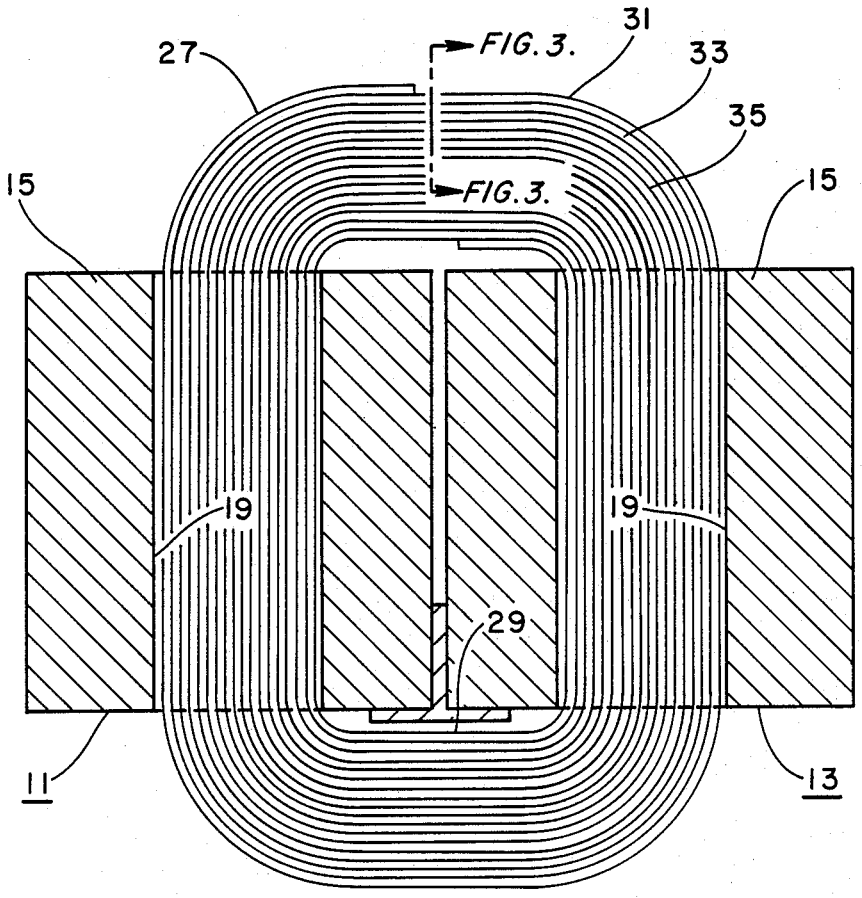
FIG. 2 is a vertical sectional view taken on line 2—2 of FIG. 1.
Figure 3:
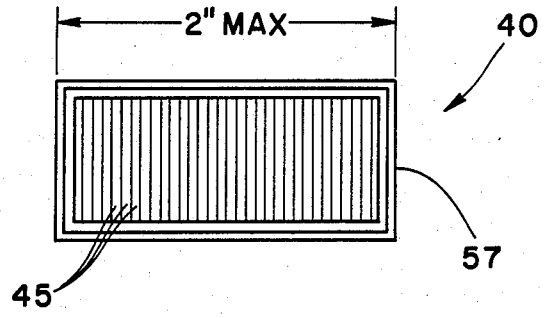
FIG. 3 is a cross sectional view of a conductor bundle.

Each high voltage winding 27 is comprised of one or more elongated conductor bundles that are wound spirally in a continuous section to form a plurality of layers or turns 31,33,35 as seen in FIG. 2. The neutral connection may be on the inside, while the high-voltage terminal is disposed on the outside. The elongated conductor bundles 40 are comprised of a plurality of extremely small rectangular conductor strands 45 as shown in FIG. 3. Each conductor strand 45 is enamel coated and will generally be in the range of 60 to 120 mils high and less than 40 mils thick. By way of example, an appropriate thickness would be 30 mils. For the purpose of this description, each of the substantially rectangular strands will be defined as having a major axis and a minor axis. The major axis is defined as the cross sectional height, while the minor axis is defined as the cross sectional width. The rectangular conductor strands 45 are layed side by side and may be bonded together using a solvent-activated adhesive over the enamel insulation. The conductor bundle is then taped with an adhesive paper 57. Preferably two layers of the adhesvie paper tape 57 will be wrapped about the conductors strands 45.

The thickness of the strands 45 across the width of the turn largely determines the magnitude of the eddy current losses due to the direction of the magnetic flux in shell-form transformers. Thus, the thickness of the strands 45 along their minor axis, (i.e. the 30 mils) and not their major axis height will determine the magnitude of the eddy current losses.

Figure 4:
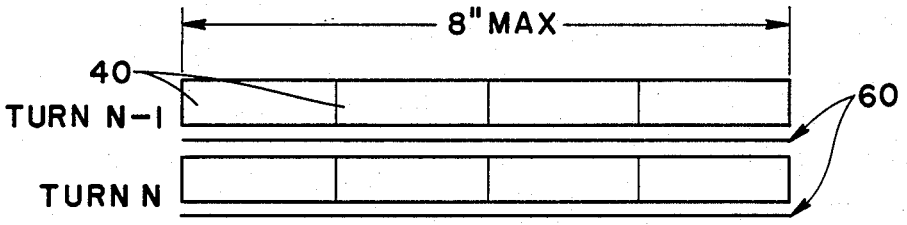
FIG. 4 is a cross sectional view showing the winding configuration through two turns of the winding as seen in FIG. 2.

During winding operations, any appropriate number of conductor bundles may be used to form a single turn. By way of example, an appropriate conductor bundle width is two inches and four or six conductor bundles may form a single turn. As seen in FIG. 4, an adhesive coated paper 60 may be inserted between the turns to aid bonding between the groups. By way of example, a suitable adhesive paper suitable for both taping the conductor bundles 40 together and for insertion between turns is 3-mil crepe paper having a heat activated adhesive applied on both of its sides.

After winding, the coil is clamped to its final dimensions and heated to cure the thermally sensitive adhesives.

Figure 5:
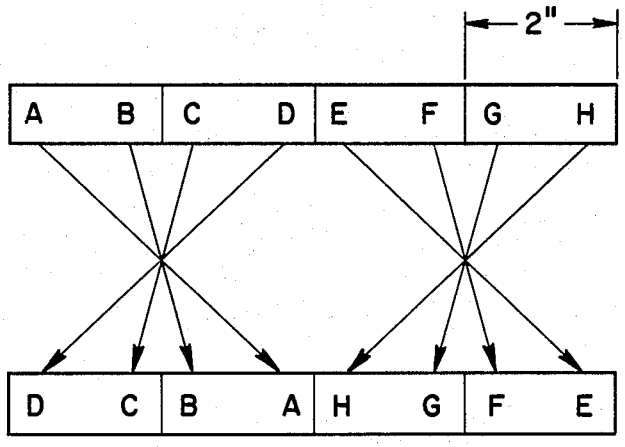
FIG. 5 is an illustration of a novel transposition pattern for the windings of the present invention.

With a symmetrical arrangement of high and low voltage windings, the necessity for transpositions of the conductors between the two halves of the high-voltage windings will not be needed. Transpositions made in each half may be made in any suitable manner as can readily be determined by those skilled in the art. By way of example, transpositions may be effectively made as shown in FIG. 5, with each half of the total turn width being separately transposed.

Finely-stranded conductors formed into bundles that are several inches wide yet only a small fraction of an inch thick have several advantages in addition to reducing eddy current losses. For example, continuous windings formed in such a manner have the advantage of greatly improving impulse voltage distribution which permits a significant reduction in turn-to-turn insulation clearances. Furhter, the circulating currents within the winding may be virtually eliminated since the cable may be nearly equivalent to continuously transposed conductors. Additionally, the overall size of the transformer may be reduced significantly since coil to coil insulation clearances in the high voltage winding groups may be eliminated.

The construction described has numerous advantages over conductor ribbons formed of a plurality of round conductor strands. For example, the use of rectangular strands facilitates a more compact design. Additionally, the short circuit strength of each group and the mechanical rigidity of the individual turns will be much better since all of the conductor strands 45 run parallel to one another. Thus good winding tension may be maintained thereby improving the mechanical properties of the finished coil. This allows the conductor bundles 40 to be tightly taped using existing machines.

Although only one embodiment of the present invention has been described, it should be understood that the present invention may be embodied in many other specific forms without departing from the spirit or scope of the invention. Particularly, the actual construction of the transformer may vary widely. For example, multiple high voltage windings may be sandwiched between each pair of low voltage windings. Both single phase and multiple phase transducer constructions are contemplated as well. The transposition scheme may also be widely varied within the scope of the present invention. Therefore, the present examples and embodiments are to be considered as illustrative and not restrictive, and the invention is not to be limited to the details given herein, but may be modified within the scope of the appended claims.

We claim:

1. A winding for an electrical induction device comprising:

an elongated conductor bundle having opposing outer and inner longitudinal surfaces defining the thickness of the bundle and a pair of opposing side surfaces defining the width of the bundle, the conductor bundle being formed from a multiplicity of insulated elongated conductor strands arranged in side by side relation, each said conductor strand having a substantially rectangular cross section with a pair of substantially parallel contact longitudinal side surfaces which serve as contact surfaces and which define the width of the strand and a pair of inner and outer longitudinal surfaces defining the thickness of the strand along a major axis, the minor axis being substantially perpendicular to the major axis, the width of the conductor strands along their minor axes being less than approximately 40 mils and substantially less than the height along their major axes, said conductor strands being mounted side by side such that their respective contact surfaces abut;

a support member, wrapped about the elongated conductor bundle to provide mechanical support; and wherein said conductor bundle is spirally wound in a multiplicity of winding turns to form a coil, the conductor bundle being wound such that said inner surfaces of the bundle and strands face the center of the coil.

2. A winding as recited in claim 1 wherein the elongated conductor strands are enamel coated to provide electrical insulation between strands.

3. A winding as recited in claim 2 further comprising an adhesive for adhering said conductor strands together.

4. A winding as recited in claim 2 wherein said support member is an adhesvie tape for insulating the conductor bundle and holding the strands together.

5. A winding as recited in claim 4 further comprising an adhesive layer for disposition between adjacent coil turns to aid bonding between the adjacent turns.

6. A winding as recited in claim 2 wherein the height of said elongated conductor strands along their major axes are in the range of approximately 60 to 120 mils.

7. A winding as recited in claim 6 wherein each said winding turn includes a plurality of conductor bundles.

8. A winding as recited in claim 7 wherein said conductor bundles are transposed at least one time.

9. In a high voltage power transformer including a magnetic core means divided into a plurality of sections, at least one low voltage winding and at least one high voltage winding, each magnetic core means section having at least one opening for receiving said windings, the windings disposed in inductive relation with the magnetic core means and extending through at least one of said core means openings, the high voltage winding having an improvement comprising:

an elongated conductor bundle having opposing outer and inner longitudinal surfaces defining the thickness of the bundle and a pair of opposing side surfaces defining the width of the bundle, the conductor bundle being formed from a multiplicity of insulated elongated conductor strands arranged in side by side relation, each said conductor strand having a substantially rectangular cross section with a pair of substantially parallel contact longitudinal side surfaces which serve as contact surfaces and which define the width of the strand and a pair of inner and outer longitudinal surfaces defining the thickness of the strand along a major axis, the minor axis being substantially perpendicular to the major axis, the width of the conductor strands along their minor axes being less than approximately 40 mils and substantially less than the height along their major axes, said conductor strands being mounted side by side such that their respective contact surfaces abut;

a support member, wrapped about the elongated conductor bundle to provide mechanical support; and wherein said conductor bundle is spirally wound in a multiplicity of winding turns to form said high voltage winding, the conductor bundle being wound such that said inner surfaces of the bundle and strands face the magnetic core means.

10. A winding as recited in claim 6 wherein the thickness of each conductor strand along its minor axis is less than 30 mils.

11. A winding as recited in claim 9 wherein:

the elongated conductor strands are enamel coated to provide electrical insulation between strands;

the height of the elongated conductor strands along their major axes are in the range of approximately 60 to 120 mils; and the support member is an adhesive tape for insulating the conductor bundle and holding the strands together.

* * * * *